United States Patent [19]

Lawrence

[11] 4,067,597

[45] Jan. 10, 1978

[54] LATCH ASSEMBLY

[75] Inventor: Dean M. Lawrence, Aurora, Ill.

[73] Assignee: Caterpillar Tractor Co., Peoria, Ill.

[21] Appl. No.: 706,709

[22] Filed: July 19, 1976

[51] Int. Cl.[2] ..... E05C 3/04

[52] U.S. Cl. ..... 292/228

[58] Field of Search ..... 292/128, 228, 122, 121, 292/125, 225, 220, 202

[56] References Cited

U.S. PATENT DOCUMENTS

| | | | |
|---|---|---|---|
| 164,941 | 6/1875 | Schneider | 292/128 |
| 755,058 | 3/1904 | Shaw | 292/338 |
| 832,020 | 9/1906 | Keil | 292/128 |
| 1,293,911 | 2/1919 | Plants | 292/128 |
| 1,891,224 | 12/1932 | Edwards | 292/228 |

*Primary Examiner*—Richard E. Moore

*Attorney, Agent, or Firm*—Phillips, Moore, Weissenberger, Lempio & Majestic

[57] ABSTRACT

A latch assembly for selectively retaining a movable portion of a vehicle. The latch assembly includes components readily sub-assembled prior to installation of the latch assembly in the vehicle. A main plate member having a tee-shaped slot and having a tubular spring retainer is provided for receiving a latch member, a coil spring and a roller member. The latch member is equipped with a pivot pin. A pair of brackets, each having a sleeve portion, are provided for receiving the latch member pivot pin and for positioning the latch member with respect to the plate member. A retainer plate, having a plurality of apertures alignable with corresponding apertures in the brackets and plate member, is welded to the vehicle for clamping the latch assembly upon the vehicle proximate to the portion to be retained.

13 Claims, 6 Drawing Figures

LATCH ASSEMBLY

BACKGROUND OF THE INVENTION

The present invention relates to a latch assembly for selectively retaining a given position of a movable member. In particular, the invention relates to a latch assembly for retaining the windshield of an earthmoving vehicle in an open position.

In the past, latching mechanisms for use in heavy duty earthmoving vehicles have often been complex, ready-made devices which had to be secured to an appropriate portion of such vehicles by means of separate securing bolts or the like. Such prior art mechanisms were also susceptible to binding or jamming conditions which often necessitated relatively difficult replacement or repair procedures in the field.

The present invention eliminates the aforementioned problems by providing a latch assembly comprised of a small number of major component parts, each separately replaceable, which are readily sub-assembled and attached to the vehicle without the need for separate securance means. The major components includes simple roller and cam arrangement which virtually eliminates binding of the latch assembly during operation.

SUMMARY AND OBJECTS OF THE INVENTION

The instant invention comprises a latch assembly for retaining a windshield or other movable part of an earthmoving vehicle in a given position. The latch assembly comprises a subassembly including a cam-equipped pivotable lever member, a spherical roller, a coil spring, a slotted spring retaining main plate member and two brackets. A clamping or retainer plate is welded to the vehicle to cooperate with sucb subassembly for windshield retention purposes. The main plate member, the brackets, and the retainer plate are each equipped with alignable apertures for receiving cap screws or the like for facile subassembly and installation of the latch assembly. The roller coacts with the cam portion of the lever member to prevent binding during operation of the assembly.

A primary object of the present invention is to provide a latch assembly for selectively retaining a movable portion of an earthmoving vehicle.

Another object of the present invention is to provide a latch assembly having few moving parts and components which may be sub-assembled and installed where needed without separate securing bolts or the like.

A further object of the present invention is to provide a smoothly-operating latch assembly for selectively retaining the movable windshield of an earthmoving vehicle.

A still further object of the present invention is to provide a cam and roller-equipped latch assembly which does not bind or stick in operation.

Other objects and advantages of the present invention will become apparent from the following drawings and description.

DETAILED DESCRIPTION

Figure 1:
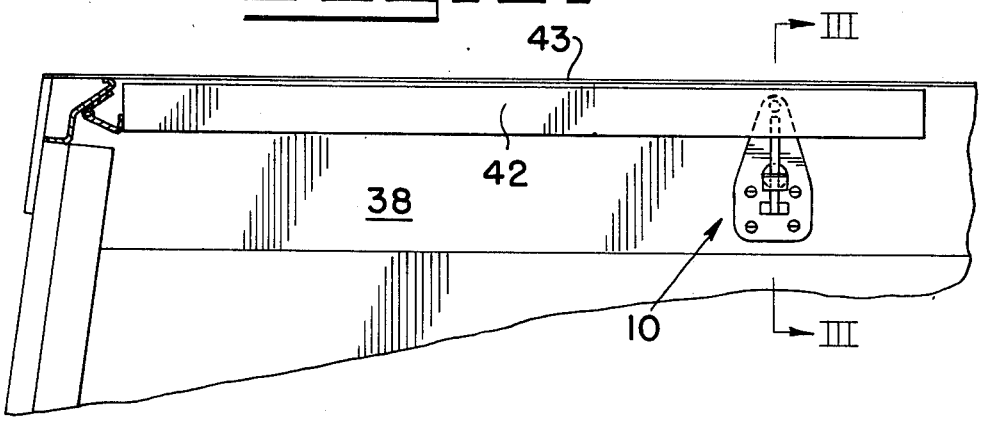
FIG. 1 is a partially cut-away view showing the present latch assembly operatively disposed for retaining a movable portion of an earthmoving vehicle.

With reference to the drawings, the inventive latch assembly may be readily appreciated within its operative context. For the purpose of illustration, the latch assembly, indicated generally at 10, is shown attached to the sidewall portion 38 of an earthmoving vehicle cab structure. The cab structure also includes a roof 43 and an opening 45 for access to the cab interior and an upwardly-swinging hinged windshield, door or the like 42. The windshield 42 is retained in an open position by the latch assembly 1, as shown in FIG. 1 and as hereinafter more fully described.

Figure 2:
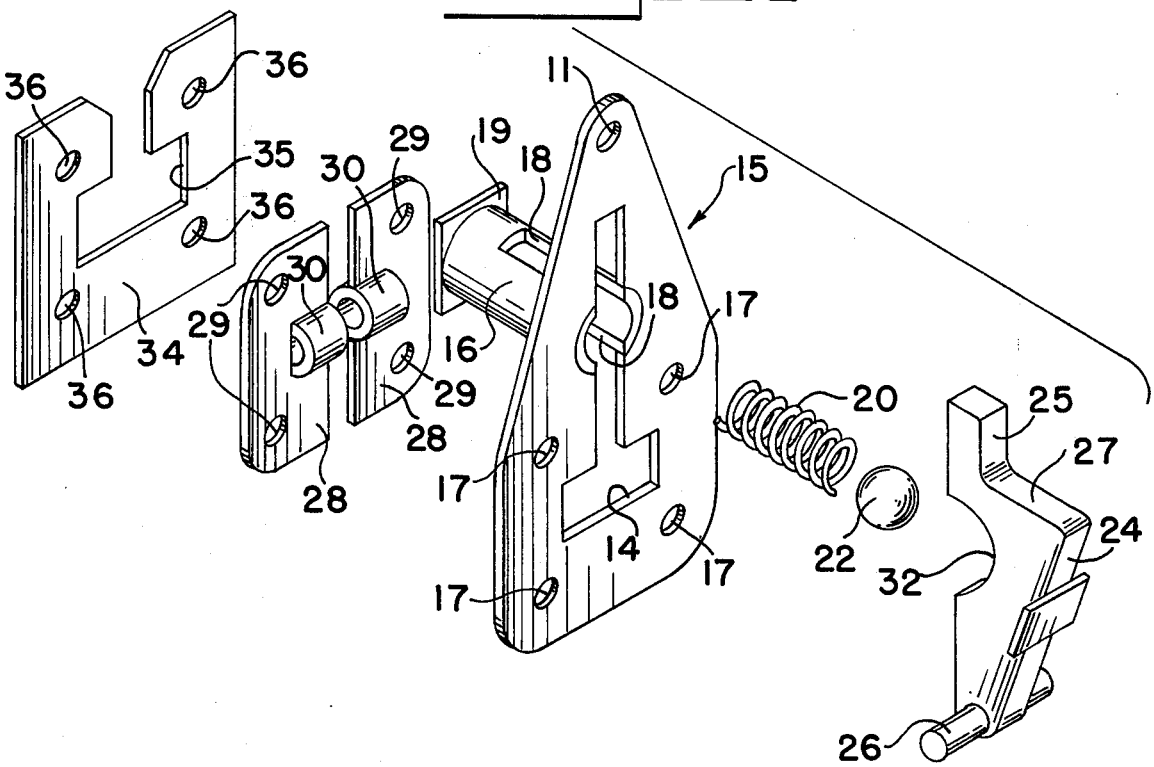
FIG. 2 is an exploded view of the present latch assembly.

With particular reference to FIG. 2 of the drawings, it may be seen that the latch assembly 10 is comprised of seven readily-assembleable components. A main plate member 12, having a modified tee-shaped slot 14 and having a rectangularly-shaped lower portion 13 and a triangularly-shaped upper portion 15, is provided with four (4) symmetrically-disposed apertures 17 and a displaced location aperture 11. The plate member 12 also incorporates a tube member 16, closed at one end by a rectangular cap member 19 and provided with a pair of diametrically opposed slots 18. The tube member 16 is welded to a correspondingly shaped cut-out portion of the slot 14, as shown. It will be noted that the slots 18 are aligned with respect to and of the same width as the longer portion of the slot 14.

The assembly is also provided with a coil spring 20 adapted to be received within the tube member 16 and to retain, at one end thereof, a spherical roller member 22.

Figure 3:
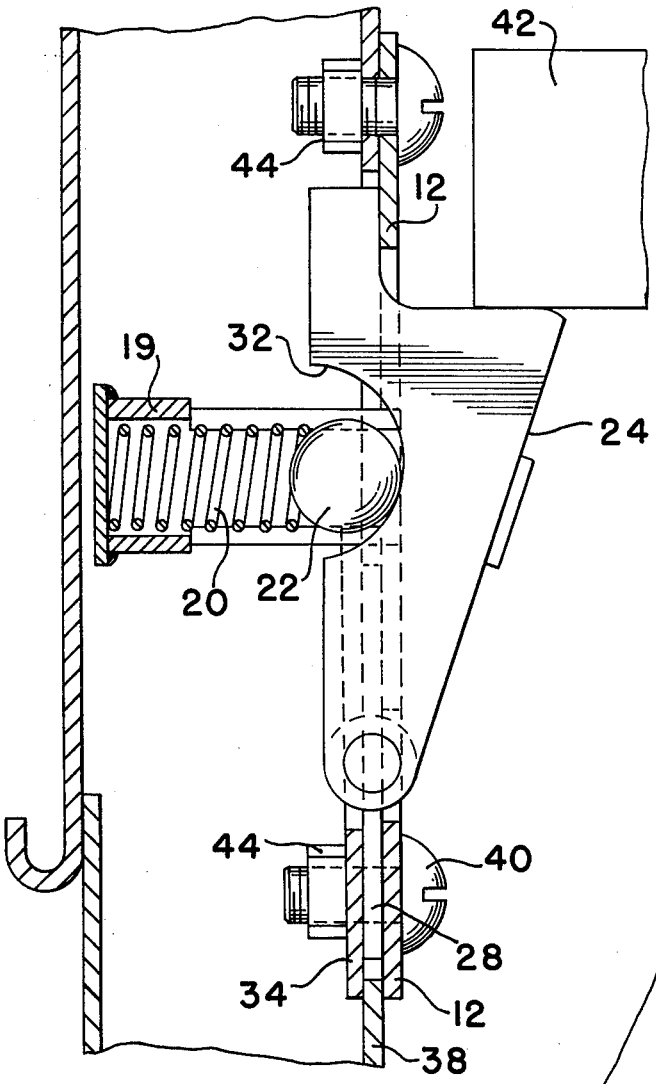
FIG. 3 is a sectional view taken along the line III—III of FIG. 1.
Figure 4:
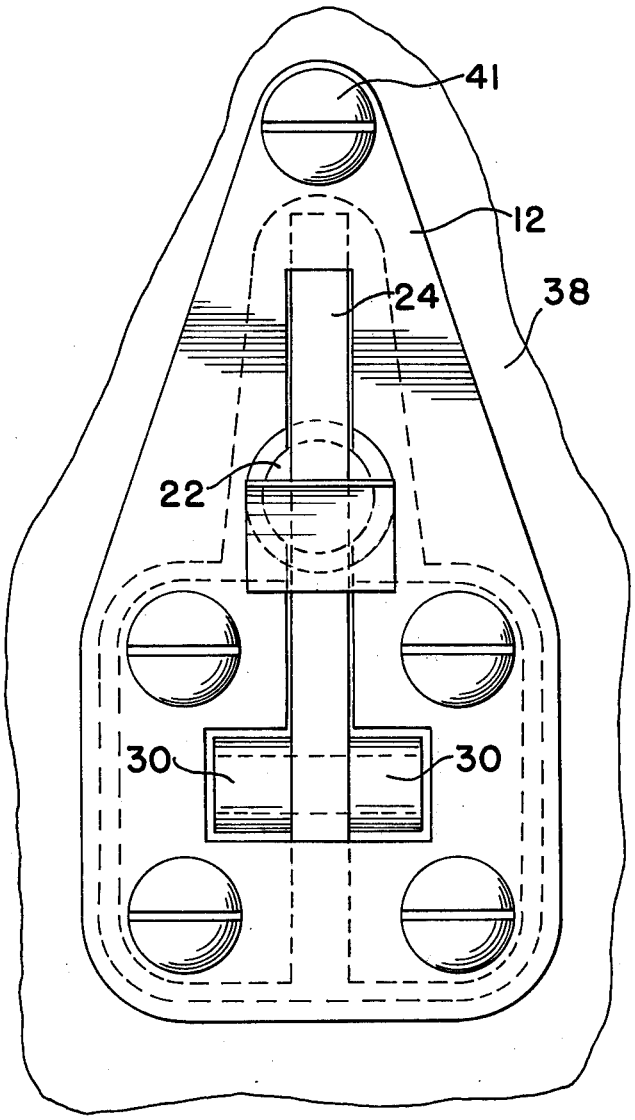
FIG. 4 is an enlarged partial view of the latch assembly shown in FIG. 1.

A latch member 24 is provided with a spherically shaped cam surface 32 for engaging the roller member 22 when the components are in assembled orientation. The latch member includes a transpiercing pin member 26 and a step or shoulder portion 27 for supporting and retaining the windshield 42, as clearly shown in FIG. 3.

The latch assembly also includes a pair of independent brackets 28, each equipped with a retainer ring or sleeve 30 and each provided with a pair of apertures 29 adapted for alignment with the apertures 17.

Finally, a retainer plate 34, having an enlarged tee-shaped slot 35 and being provided with four apertures 36, adapted for alignment with the apertures 29 and 17, is provided to cooperate with the latch sub-assembly for windshield retention purposes. The retainer plate is preferably secured directly to the cab, such as by welding, prior to installation of the latch sub-assembly thereon.

In practice, the major components of the latch assembly (excluding retainer plate 34) are conveniently sub-assembled before attachment to the vehicle cab structure. The spring 20 is inserted into the tube member 16 and the roller member 22 is placed within the tube member in operative engagement with the spring 20. Next, the pin member 26 of the latch member 24 is inserted through the enlarged portion of the slot 14 and each of the retainer sleeves 30 of the brackets 28 is fitted over an oppositely-extending portion of the pin member 26. The bracket apertures 29 are then aligned with the apertures 17 just after the spring 20 has been compressed through the application of force to the latch member 24 in the direction indicated by the arrow in FIG. 2. This procedure positions an upwardly-extending top portion 25 of the latch member retainably behind the plate member 12, as clearly shown in FIG. 3. So positioned, only the shoulder portion 27 extends outwardly through the longer portion of the slot 14 and the cam surface 32 engages the roller 22 and extends freely movably within the tube slots 18. Capscrews 40 are then inserted through the apertures 17 and 29 to complete the sub-assembly of the mechanism.

When it is desired to install the sub-assembly in the sidewall 38 of the vehicle cab, apertures 17 and 29 are aligned with apertures 36 of retainer plate 34 to receive capscrews 40 so that the sidewall 38 is effectively clamped between the plates 12 and 34. The installation is completed when a capscrew 41 is installed through the locator apertures 11 and a locator hole in the sidewall 38. The capscrews are suitably tightened by means of threaded weld nuts 44 or the like, welded to a back side of the retainer plate.

Figure 5:
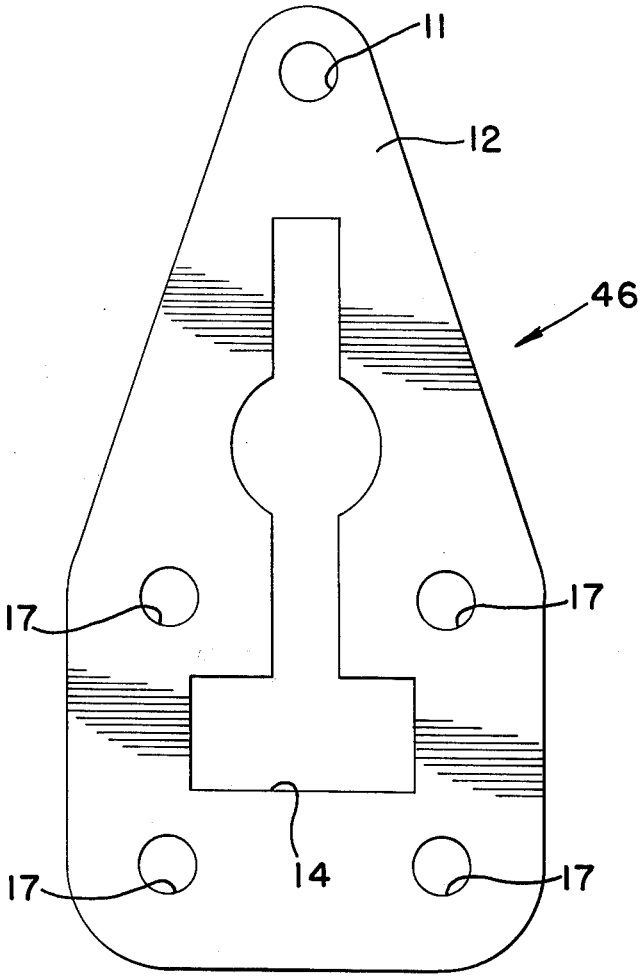
FIG. 5 is a front elevational view of a shim which may be alternately used with the latch assembly.
Figure 6:
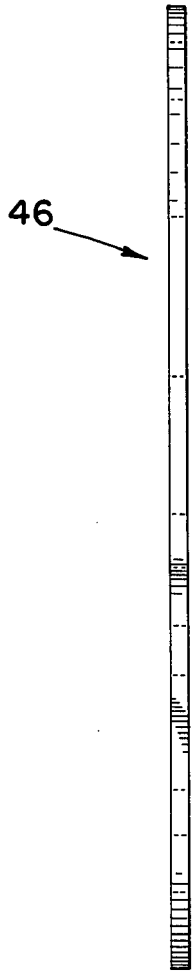
FIG. 6 is a side elevational view of the shim.

As shown in FIGS. 5 and 6, one or more shims 46 may be installed between plate 12 and sidewall 38 to control the position of the latch accurately with respect to the windshield. The shim is preferably of the same configuration as main plate member 12, but is substantially thinner.

It may be readily seen that the present invention provides a highly efficient, readily installable latch assembly for retaining a selectively positionable portion of an earthmoving vehicle. The instant unit comprises a plurality of component parts which can be readily sub-assembled and installed in situs with only a minor fastening procedure.

Although the invention has been described and illustrated with reference to a particular preferred embodiment, it will be apparent to those skilled in the art that many variations and modifications are possible within the spirit of the inventive concepts. No limitation is intended with respect to such variations and modifications except those implicit in the scope of the appended claims.

What is claimed is:

1. A multi-component latch assembly for selectively retaining a movable element, said latch assembly comprising:

main plate means;

pivotable latch member means for selectively engaging and retaining said movable element, said main plate means including a main slot, said latch member means being operatively received within said main slot of said main plate means;

biasing means retained by said main plate means for biasing said latch member means in a first predetermined direction;

bracket means having sleeve means for pivotally retaining said latch member means within said main slot;

retainer plate means for securing said latch assembly to a supporting structure during use; and securing means for securing said bracket means and said main plate means to said retainer plate means such that said components of said latch assembly are thereby positioned in an operative orientation.

2. The invention of claim 1 wherein said latch member means include a cam surface, roller means for engaging said cam surface, said roller means being retained by said main plate means and being engaged concurrently by said biasing means and said cam surface.

3. The invention of claim 1 wherein said bracket means comprises two separate identical bracket portions, each including sleeve means portions formed thereon, such that said latch member means is non-removably pivotally retained within said bracket means when said bracket is secured with said main plate means to said retainer plate means.

4. The invention of claim 1 wherein said main plate means includes a tube member, said biasing means being operatively received within said tube member, and wherein said main slot has an enlarged laterally-extending portion and an elongated portion disposed normally to said laterally-extending portion, and said tube member has a pair of opposed tube slots of the same width as said elongated portion and in alignment with said elongated portion of said main slot for removably receiving said latch member means.

5. The invention of claim 4 wherein said securing means comprises a plurality of fastening means disposed in a plurality of concurrently alignable apertures defined on said main plate means, said bracket means, and said retainer plate means, said fastener means performing the dual functions of retaining all of the components of said latch assembly assembled in operative orientation while securing said latch assembly to said supporting structure.

6. The invention of claim 5 wherein said fastening means comprise a plurality of readily removable cap screws.

7. The invention of claim 5 wherein said latch member means include oppositely-extending pin means for being removably journalled within said sleeve means of said bracket means, said sleeve means and said pin means being operatively positioned within said enlarged laterally-extending portion of said main slot when said fastening means are in place within said concurrently alignable apertures, such that a portion of said sleeve means projects through said main slot of said main plate means.

8. The invention of claim 7 wherein said latch member means further include a shoulder surface for directly engaging said movable element.

9. The invention of claim 5 wherein said main plate means further include locator aperture means for receiving a fastener to locate said latch assembly with respect to said supporting structure.

10. The invention of claim 7 wherein said retainer plate means include a further enlarged slot for receiving said sleeve means when said fastening means are in place within said concurrently alignable apertures.

11. The invention of claim 1 further comprising a vehicle cab comprising a windshield movably mounted thereon to constitute a movable element adapted to be retained by said latch assembly and a wall constituting a supporting structure having said latch assembly secured thereon.

12. The invention of claim 11 further comprising at least one shim disposed between said wall and said main plate means.

13. The invention of claim 12 wherein said shim is configured at least substantially the same as said main plate means but is substantially thinner than said main plate means.

* * * * *